United States Patent [19]

Rampe

[11] 4,074,466

[45] Feb. 21, 1978

[54] VIBRATORY FINISHING SYSTEM

[75] Inventor: John F. Rampe, Cleveland, Ohio

[73] Assignee: Rampe Research, Cleveland, Ohio

[21] Appl. No.: 782,519

[22] Filed: Mar. 29, 1977

[51] Int. Cl.[2] ..... B24B 31/00

[52] U.S. Cl. ..... 51/163.1; 51/313; 222/161

[58] Field of Search ..... 51/163.1, 163.2, 313–316, 51/7; 222/494, 161, 203

[56] References Cited

U.S. PATENT DOCUMENTS

| | | | |
|---|---|---|---|
| 1,991,126 | 2/1935 | Stevenson | 222/494 X |
| 2,161,230 | 6/1939 | Nelson | 222/494 |
| 3,337,997 | 8/1967 | Rampe | 51/163.1 |
| 3,685,213 | 8/1972 | Rampe | 51/163.1 |
| 3,694,968 | 10/1972 | Isaacson | 51/163.1 |

*Primary Examiner*—Harold D. Whitehead

*Attorney, Agent, or Firm*—David A. Burge Co.

[57] ABSTRACT

A vibratory finishing machine has an elongated tub including a longitudinally extending wall closed at opposite ends. A discharge passage is provided through one of the tub ends and communicates with a discharge spout having an inclined U-shaped terminal edge. A flexible closure is draped over the discharge spout and engages the terminal edge to retain workpieces and media in the tub. An adjustable weight arrangement is provided on the closure for selectively controlling the closing force operative between the closure and the terminal edge. Workpieces and media in the discharge spout bear against the closure and bias the closure in an opening direction. When the opening force imposed by the workpieces and media exceeds the closing force applied by the weight arrangement, the closure opens to discharge workpieces and media from the tub.

18 Claims, 4 Drawing Figures

VIBRATORY FINISHING SYSTEM

CROSS-REFERENCE TO RELEVANT PATENTS

*Finishing Apparatus,* U.S. Pat. No. 3,318,051 issued May 9, 1967 to John F. Rampe, here the "Finishing Patent."

*Finishing Apparatus,* U.S. Pat. No. 3,337,997 issued Aug. 29, 1967 to John F. Rampe, here the "Orbital Patent."

*Vibratory Finishing Machine, U.S. Pat. No.* 3,449,869 issued June 17, 1969 to John F. Rampe, here the "Dual Shaft Patent."

*Clamping Means For Tub Liners,* U.S. Pat. No. 3,538,651 issued Nov. 10, 1970 to John F. Rampe, here the "Tub Liner Patent."

*Continuous Feed Vibratory Finishing Machine With Discharge Rate Controlled By Operation Of Tub Discharge Closure,* U.S. Pat. No. 3,831,322 issued Aug. 27, 1974 to John F. Rampe, here the "Continuous Feed Patent."

*Finishing Apparatus With Improved End-Of-Tub Liner And Door Structure,* U.S. Pat. No. 3,906,680 issued Sept. 23, 1975 to John F. Rampe, here the "Door Assembly Patent."

*Finishing System Wih Cyclically Operable Closure Control,* U.S. Pat. No. 3,959,932 issued June 1, 1976 to John F. Rampe, here the "Object Sensor Patent."

BACKGROUND OF THE INVENTION

1. Field of the Invention

The present invention relates generally to finishing machines and more particularly to vibratory finishing machines of the continuous feed type having discharge systems for controlling the retention time of workpieces within the tubs of the machines.

2. Prior Art

Vibratory finishing machines for smoothing and finishing workpiece surfaces by such operations as deburring, burnishing, descaling, and cleaning are well known, as is apparent from the disclosures in the referenced Finishing Patent, Orbital Patent, Dual Shaft Patent, and Continuous Feed Patent. Such machines commonly employ a movably mounted processing tub for receiving a quantity of workpieces and abrasive finishing media. A finishing action is imparted to the workpieces by vibrating the tub.

The type of abrasive media used in finishing operations varies substantially depending on the type of operation to be conducted. In many finishing operations, the abrasive finishing media comprises a multiplicity of modestly sized, generally triangular abrasive stones, and a small quantity of finishing liquid.

As is explained more fully in the above-cited patents, to which reference is made for a more complete description of finishing machines and techniques, the abrasive finishing media is conveniently separated from the workpieces after the media and the workpieces are discharged from the tub. After separation, the abrasive media is returned to the tub for reuse. The finishing liquid is usually drained off during separation of the media and workpieces and may also be returned to the tub for reuse. The finished workpieces are then normally conveyed to a separate unit or units for washing, drying, inspection and packaging.

Vibratory finishing machines are often categorized as being either of the batch type or the continuous feed type. In a batch-type operation, the machine is fully loaded, a finishing operation is carried out, and the machine is completely emptied. In continuous feed operation, media and workpieces are introduced into the tub near one end and are subjected to a finishing operation during orbital movement toward a discharge outlet at the opposite tub end. Continuous feed machines may be truly continuously fed, as by the use of charging conveyors or the like, or may periodically be fed with charges of media and workpieces. Regardless of how the machines are fed, they may continuously or periodically discharge quantities of the media-workpiece mixture through the tub outlet.

One problem with many prior continuous feed machine proposals is that the time during which workpieces are retained in the tub is not readily controllable. Workpieces of relatively soft metal or workpieces needing only minimal deburring require only short retention times to complete a finishing operation. Workpieces of harder metal or workpieces having many large burrs to be removed require longer retention times for satisfactory finishing. Where the required retention time of a particular operation differs from the design characteristics of the continuous feed machine in which the operation is to be performed, it may be necessary to operate the machine on a batch basis to effect adequate control of tub time.

The machines described in the referenced Continuous Feed Patent and Door Assembly Patent are provided with discharge systems for controlling retention time. These machines may be operated on a batch basis, if necessary, but are designed primarily for continuous operation wherein their discharge closures are opened and closed by a time control device preset to selected intervals of operation. Once a closure operating cycle has been decided upon, the operator adjusts the timing mechanism to close the discharge, typically for about 10 seconds, for processing workpieces in the tub. This is normally followed by a release period, typically about five seconds, for discharging part of the materials from the tub. This cycle of closure operation is continuously repeated and establishes an effective rate of material discharge from the tub which, in turn, determines the time span during which workpieces are retained in the finishing tub. In the event the finishing operation calls for longer or shorter processing times, the operator resets the time mechanism to provide correspondingly longer or shorter workpiece retention periods.

Although the closure control system described in the Door Assembly Patent operates quite satisfactorily to control workpiece retention time, the system is rather expensive. The control system required to vary the operating cycle and the associated safety systems (see the Object Sensor Patent) needed to prevent the crushing of workpieces trapped between the closure and tub outlet are relatively complex and add significantly to the cost of the machine.

SUMMARY OF THE INVENTION

The present invention overcomes the foregoing and other disadvantages of the prior art by providing a novel and improved discharge system including improved finishing methods and apparatus. One feature of the invention resides in the provision of a discharge structure of extremely simple construction which is capable of controlling workpiece retention time in continuous feed vibratory finishing machines.

A vibratory finishing machine is provided with a tub having a longitudinally extending wall closed at opposite ends. An outlet is provided through one of the tub ends at the level of the tub bottom. The longitudinally extending wall defines a generally horizontal path of workpiece-media mixture movement toward the outlet. The outlet is closed by a flap-type gate or closure. The media-workpiece mixture in the tub bears against the closure in an opening direction allowing the workpieces and media to discharge.

The tub outlet provides a terminal edge which is inclined at an acute angle to the horizontal. A flexible flap-type closure is mounted for movement toward and away from the terminal edge and is exposed to pressure forces generated by the weight of the media-workpiece mixture bearing against the closure. A set of adjustable, individually removable weights bias the closure toward engagement with the terminal edge to close the tub outlet.

The addition of media-workpiece mixture to the tub increases pressure forces exerted by the mixture on the closure until it overcomes the closing force applied by the weights. The closure accordingly opens and material discharges from the tub. Discharge continues until the closing force applied by the weights exceeds the opening force applied by the media-workpiece mixture. The closure then moves to a closed position and discharge stops. This action continues in a cyclical fashion providing periodic discharge of materials through the tub outlet and establishing an effective rate of material movement through the tub. As will be apparent, the rate at which materials move through the tub determines the period during which workpieces are retained in the tub, i.e., tub retention time.

In order to increase tub retention time, more weight is added to the closure thereby requiring greater pressure forces to discharge materials, and thereby lengthening tub retention time. In order to decrease tub retention time, weights are removed from the closure thereby permitting pressure forces of lesser magnitude to open the closure.

It has been found that the discharge system of this invention is particularly effective when the size and mass of the individual workpieces is substantially greater than the size and mass of the media.

It is an object of this invention to provide an improved vibratory finishing system, including finishing methods and apparatus for controlling the nature of a finishing action imparted to workpieces.

Other objects and a fuller understanding of the invention may be had by referring to the following description and the claims taken in conjunction with the accompanying drawing.

DESCRIPTION OF THE PREFERRED EMBODIMENT

Figure 1:
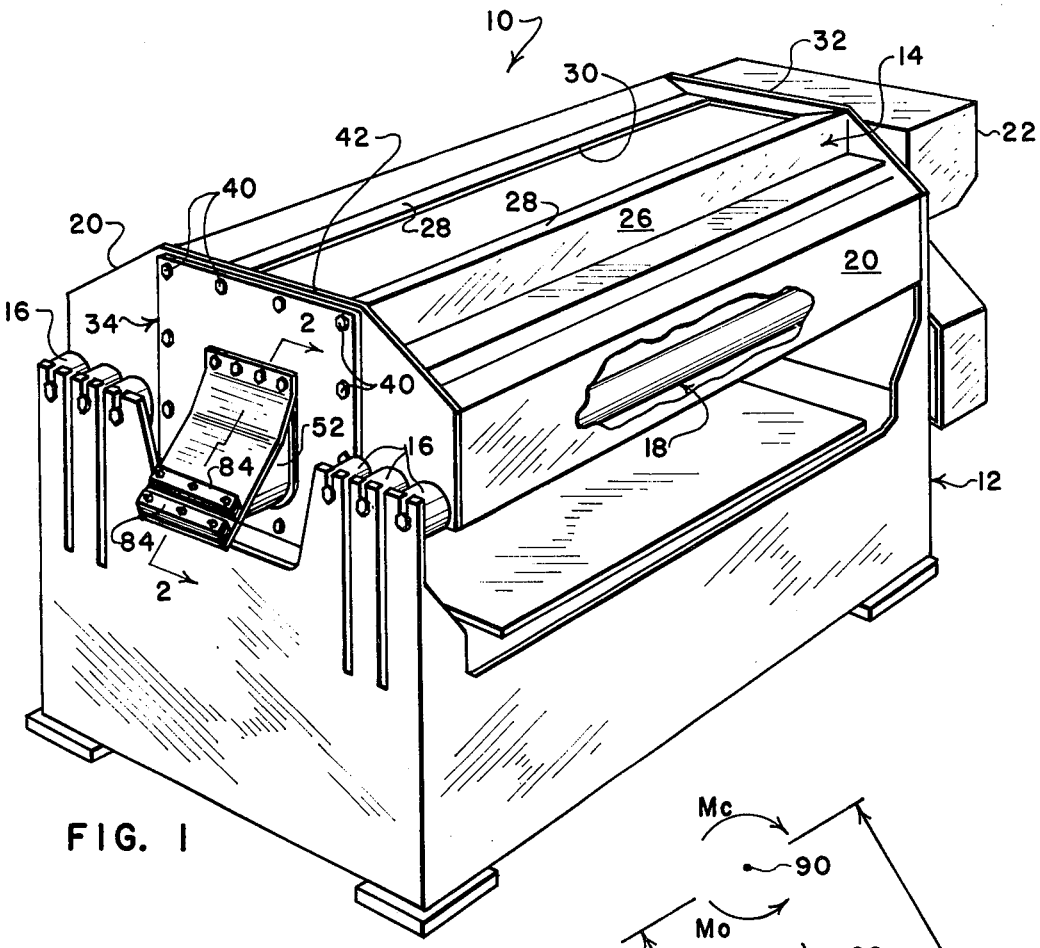
FIG. 1 is a perspective view of a vibratory finishing machine incorporating a preferred practice of the present invention.

Referring to FIG. 1, a continuous feed vibratory finishing machine 10 comprises a frame 12 and a tub 14 mounted thereon for vibratory movement by a plurality of substantially cylindrical, resilient, elastomeric mounts 16. A vibratory drive system is provided to vibrate the tub 14. The drive system typically includes such elements as rotatable eccentric weights 18 disposed in elongated housings 20 on opposite sides of the tub 14. A suitable guard 22 encloses a power transmission system which rotates the eccentrics 18 in synchronism, as described in the referenced Dual Shaft Patent.

Figure 2:
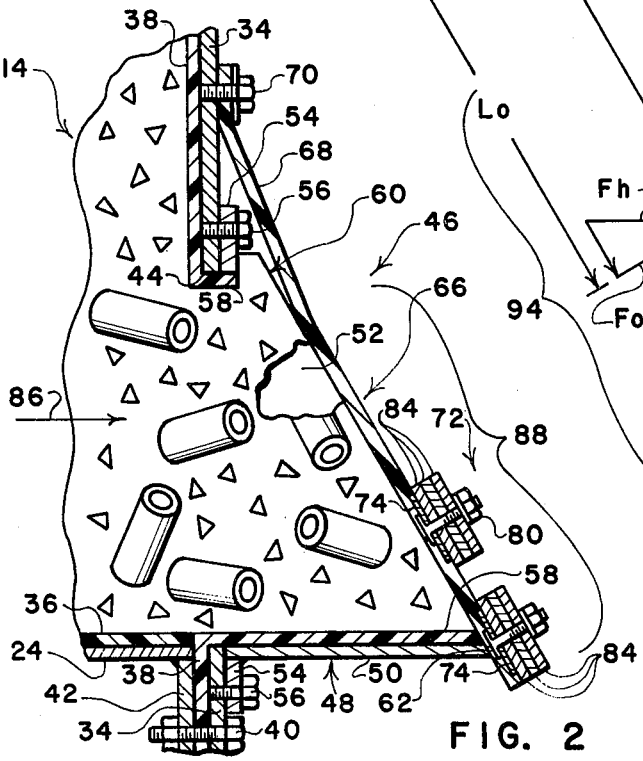
FIG. 2 is an enlarged cross-sectional view of the machine of FIG. 1 as seen from a plane indicated by a line 2—2 in FIG. 1.

The tub 14 is of the type described in the referenced Dual Shaft Patent. Referring to FIGS. 1 and 2, the tub 14 has a bottom wall portion 24 and upstanding sidewall portions 26 which cooperate to define an elongated, generally U-shaped trough into which workpieces and finishing media may be deposited for finishing. Upper ends of the sidewall portions 26 have longitudinally extending flanges 28 which define a tub opening 30 therebetween. A pair of inlet and outlet end plates 32, 34 close opposite ends of the tub 14.

Inwardly facing surfaces of the wall portions 24, 26 are covered with a resilient layer of tub lining material 36, as described in the referenced Tub Liner Patent. Inwardly facing surfaces of the inlet and outlet end plates 32, 34 are covered by sheets of tub lining material, as described in the referenced Door Assembly Patent, one of which sheets is indicated by the numeral 38 in FIG. 2. Bolts 40 clamp the liner sheet 38 between the outlet end plate 34 and a flange-defining structure 42 which is welded to the end of the tub 14.

The outlet plate 34 provides an outlet opening 44 in alignment with the bottom of the tub 14 so that media, finished workpieces, and such other materials as may be present in the tub 40 may be discharged without obstruction. A discharge structure 46 comprising an important part of this invention is affixed to the outlet end plate 34, and periodically opens to allow the discharge of material from the tub 14.

The discharge structure 46 comprises a discharge spout 48 of generally U-shaped cross-section. The discharge structure 46 has a bottom wall portion 50 which is generally coplanar with the bottom tub wall portion 24, and has a pair of generally upright sidewall portions 52. The discharge spout 48 is welded to a mounting plate 54. The mounting plate 54 is secured to the tub end 34 by a plurality of suitable threaded fasteners 56. The tub end liner sheet 38 has portions 58 which extend into the spout 48 and line its interior surfaces.

The discharge spout 48 has a terminal edge 60 which defines a discharge opening 62 at one end of the discharge spout 48. All surface portions of the terminal edge 60 lie in a common plane which is inclined at an acute angle relative to the plane of the outlet end plate 34. The terminal edge 60 is positioned so that a closure 66 can be draped over it and can be biased into firm engagement thereagainst by its own weight, thereby closing the discharge opening 62.

The closure 66 preferably comprises a member 68 formed of any suitable resilient, flexible material, for example, an organic polymeric material such as urethane. The resilient character of the member 68 protects it from the abrasive action of material discharging through the discharge opening 62, and protects the materials from being scratched or otherwise damaged by the member 68. The member 68 is pivoted or swingably mounted on the outlet end plate 34 for movement toward and away from the terminal edge 60. In the preferred embodiment, a plurality of threaded fasteners 70 clamp upper portions of the member 68 into rigid engagement with the outlet end plate 34. Since the center of gravity of the closure 66 is spaced from the fasteners 70, it will be evident that a gravitationally induced clockwise moment is applied to the member 68 tending to force or bias lower portions of the member 68 into firm engagement with the terminal edge 60.

In operation, a mixture of media and workpieces to be finished is added to the tub 14 through the opening 30 at a location away from the tub outlet opening 44. The mixture migrates through the tub 14 in a helical, orbital fashion, precessing toward the tub outlet opening 44 as the eccentric mechanisms 18 vibrate the tub 14. The mixture ultimately passes through the outlet opening 44 and is received in the discharge spout 48. As the discharge structure 46 opens and closes periodically, it establishes an effective rate at which mixture discharges from the spout 48 through the discharge opening 62. The effective discharge rate established by the discharge structure 46, in turn, determines the effective average retention time for workpieces in the tub 14.

Figure 3:
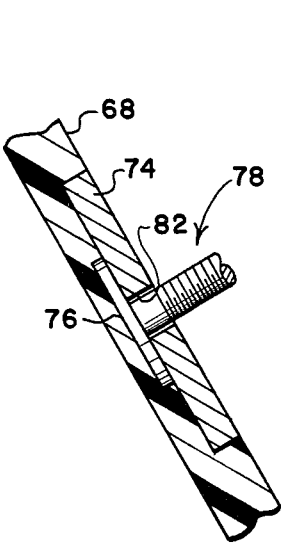
FIG. 3 is an enlarged portion of the illustration of FIG. 2.

An adjustable weight arrangement 72 is provided on lower portions of the closure member 68. As is shown in FIGS. 2 and 3, the weight arrangement 72 includes two metallic plates 74 embedded in the member 68 and captivating thereunder the heads 76 of a plurality of bolts 78. The bolts 78 project through openings 82 formed in the plates 74 and carry nuts 80 on their threaded ends to clamp a plurality of weight plates 84 in place adjacent the member 68.

The size and placement of the weight plates 84 are selected to efficiently position the closure member 68 in engagement with the terminal edge 60 for closing the outlet opening 62. The weight plates 84 are of sufficient length to span the distance between the spout sidewalls 52, as is best seen in FIG. 1. The weight plates 84 are arranged in an upper and lower set, and the lowermost set is disposed in substantially the same horizontal plane as the bottom edge of the discharge opening 62. The uppermost set of the weights 84 is spaced only slightly above the lowermost set. Both of the sets of weights 84 are disposed toward the lower half of the discharge opening 62.

Figure 4:
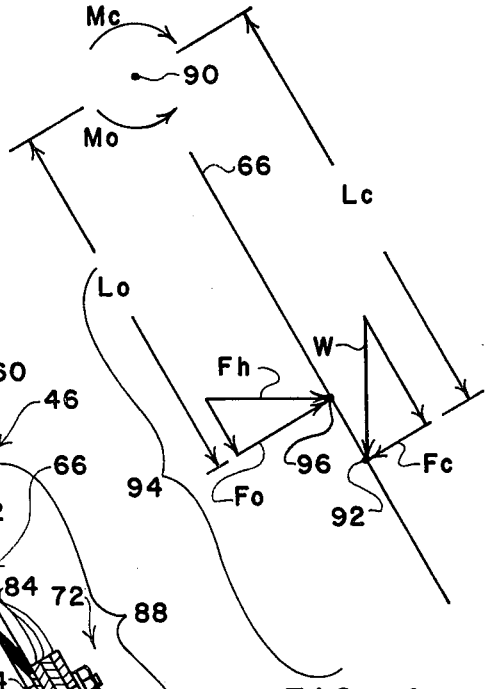
FIG. 4 is a diagram illustrative of the forces acting on the outlet closure of the finishing machine.

Referring to FIG. 4, there is illustrated a schematic representation of the forces acting on the closure 66 during operation of the finishing machine 10. For purposes of illustration, it may be assumed that the closure 66 is mounted for pivotal movement about an axis represented by a point 90. The effective weight of the closure 66 and of the weight arrangement 72 is represented by an arrow W. The weight force W acts through a center of gravity indicated by a point 92 to produce a force component indicated by an arrow $F_c$. The force component $F_c$ tends to bias the closure 66 toward the terminal edge 60 and thereby produces a clockwise closing moment indicated by the arrow $M_c$. The moment $M_c$ is the product of the force $F_c$ and its distance $L_c$ to the pivot axis 90.

Opposing the closing moment $M_c$ is an opening moment indicated by an arrow $M_o$ about the axis 90. The opening moment $M_o$ is caused by a component of the weight or mass of the workpiece-media mixture in the tub, which component can be thought of as a pressure force acting against the closure 66. While vibration of the mixture is occurring, the mixture assumes many characteristics of a fluid and essentially exerts a pressure force on such portions 94 of the closure 66 as are in contact with the media-workpiece mixture. This pressure force can be integrated with respect to the area of the region 94 to give a comparable horizontal force indicated by an arrow $F_h$. The horizontal force $F_h$ includes a component or an opening force indicated by an arrow $F_o$ acting through a center 96 of the region 94. The magnitude of the opening moment $M_o$ is the product of the force $F_o$ and its distance $L_o$ from the pivot axis 90.

The closure 66 moves toward an open position whenever the opening moment $M_o$ exceeds the closing moment $M_c$. The closure 66 moves toward a position closing the outlet opening 62 when the closing moment $M_c$ exceeds the opening moment $M_o$. Because the closing moment $M_c$ is substantially constant unless the weight arrangement 72 is modified, it is apparent that the opening of the closure 66 is a function of the magnitude of the opening force $F_o$ and is accordingly a function of the pressure forces exerted by the media-workpiece mixture on the closure 66.

Since the closure 66 opens and closes as a function of the weight of the media workpiece mixture in the tub 14, it will be evident that the closure 66 opens and closes as a function of the rate at which workpieces and/or media are introduced into the tub 14. As workpieces and media are periodically or continuously added to the content of the tub 14, the weight of the mixture and hence the pressure forces applied to the closure 66 will increase, thereby increasing the horizontal force component $F_h$ and consequently increasing the opening moment $M_o$. At some time during the addition of media and workpieces to the tub 14, and in view of the precessing action of workpieces and media in the tub 14, the opening moment $M_o$ will exceed the closing moment $M_c$ thereby causing the closure to move 66 to an open position allowing discharge of media and workpieces through the discharge opening 62. At some time during the discharge of workpieces and media from the tub 14, the pressure forces applied to the closure 66 by the mixture of media and workpieces decreases to a point where the closing moment $M_c$ exceeds the opening moment $M_o$, thereby causing the closure 66 to move to a closed position.

The illustration and description relating to FIG. 4 is something of an oversimplification inasmuch as it assumes that the closure 66 is rigid, which of course, it is not. Due to the flexibility of the closure 66, the pivot axis 90 is not precisely fixed. Nonetheless, it will be understood that FIG. 4 and the discussion associated with it present a reasonably accurate description of the type of force interactions which cause the closure to periodically open and close.

An interesting and totally unexpected phenomena has been discovered in conjunction with the operation of the described discharge system. It has been found that small abrasive finishing media is apparently retained in the tub 14 with lower pressures than are required to retain large workpieces in the tub 14. Accordingly, the discharge structure 46 can be used, to some extent, to discriminate between relatively small media and relatively larger workpieces and to thereby provide a discharge mixture which has a relatively higher percentage of workpieces than would otherwise normally occur. Stated in another way, it is apparent that relatively large, massive workpieces are more effective in providing the force component $F_h$ shown in FIG. 4 than are relatively smaller abrasive finishing media, and the closure 66 will open more readily in response to these workpieces bearing against it than it will in response to the pressure of finishing media. While this phenomena is not fully understood, its discovery is significant in that it permits media to be retained in the tub 14 more effectively than would otherwise occur, while permitting workpieces to discharge without obstruction.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A vibratory finishing machine comprising a frame, a tub adapted to receive workpieces and finishing media and having an outlet for workpieces and finishing media, mounting means mounting the tub on the frame for vibratory movement, vibratory drive means for vibrating the tub to impart a finishing action to its contents, and discharge means for discharging workpieces and media through the tub outlet including closure means responsive to pressure forces exerted by tub contents on the closure means for periodically opening and closing the tub outlet.

2. The machine of claim 1 wherein the tub outlet includes a discharge spout providing a terminal edge defining an acute angle with a horizontal plane, and wherein the closure means is mounted for movement toward and away from engagement with the terminal edge for opening and closing the tub outlet, and biasing means biasing the closure toward the terminal edge.

3. The machine of claim 2 wherein the discharge means additionally includes means for adjusting the force of the biasing means.

4. The machine of claim 3 wherein the mounting means comprises means swingingly mounting the closure means on the tub, and the bias adjusting means comprises means for increasing and decreasing the closing moment of the biasing means on the closure means.

5. The machine of claim 4 wherein the biasing means comprises weights.

6. The machine of claim 2 wherein the closure means is flexible, at least in part.

7. A vibratory finishing machine comprising a frame, a tub adapted to receive workpieces and finishing media and having an inlet and an outlet for workpieces and media, mounting means mounting the tub on the frame for vibratory movement, vibratory drive means for vibrating the tub to impart a finishing action to its contents, and discharge means for periodically opening and closing the tub outlet to cyclically discharge contents from the tub, the discharge means being responsive to the rate at which workpieces and media are added to the tub through the tub inlet.

8. A vibratory finishing machine comprising a frame, a tub adapted to receive workpieces and finishing media and having an outlet for workpieces and media, mounting means mounting the tub on the frame for vibratory movement, vibratory drive means for vibrating the tub to impart a finishing action to its contents, and discharge means responsive to the height of workpieces and media adjacent the tub outlet for periodically opening and closing the tub outlet.

9. A vibratory finishing machine comprising a frame, a tub having an outlet for workpieces and media, the tub including a discharge spout having a terminal edge, mounting means mounting the tub on the frame for vibratory movement, vibratory drive means for vibrating the tub, discharge means for discharging workpieces and media through the tub outlet including a bodily flexible closure, means mounting the closure for swinging movement toward and away from closing engagement with the terminal edge while in positions exposed to pressure forces exerted on the closure by the media and workpieces in the tub, which pressure forces tend to bias the closure away from the terminal edge, and biasing means for biasing the closure toward engagement with the terminal edge.

10. The machine of claim 9 wherein:

(a) the tub outlet comprises a discharge spout of generally U-shaped providing the terminal edge;

(b) the terminal edge extends at an acute angle with a horizontal plane; and, (c) the biasing means comprises at least one weight releasably mounted on the closure.

11. The machine of claim 10 wherein the weight comprises a multiplicity of weights each of which is individually removable from the closure to provide a means of controlling the magnitude of the biasing force exerted by the biasing means on the closure.

12. The machine of claim 10 wherein, when the closure is in a closed position, the weight is disposed generally parallel to a lowermost portion of the terminal edge.

13. The machine of claim 12 wherein the weight is of sufficient dimension to span opposite sides of the terminal edge.

14. The machine of claim 13 further comprising an additional weight of sufficient length to span the sides of the terminal edge, and means mounting the additional weight in contact with the closure and spaced from the first mentioned weight.

15. A method of finishing workpieces in the presence of a finishing media comprising the steps of:

(a) introducing workpieces to be finished and finishing media into the tub of a vibratory finishing machine of the type having a discharge structure including a closure for selectively opening and closing a tub outlet, the workpieces being introduced at a tub location removed from the discharge structure;

(b) vibrating the tub to impart a finishing action to the workpieces and media in the tub to perform a finishing operation on the workpieces and to move the workpieces and media from said location toward the tub outlet; and, (c) periodically opening the closure in response to the presence of workpieces bearing thereagainst for discharging the workpieces and closing the closure.

16. The method of claim 15 wherein the workpieces are substantially larger in size and mass than the individual pieces of finishing media, the closure includes an adjustable biasing means for controlling the biasing force with which it is biased toward a closed position, and the method additionally includes the step of adjusting the biasing means so that the closure will open more readily in response to the presence of workpieces bearing thereagainst than it will in response to media bearing thereagainst.

17. The method of claim 15 wherein the closure is bodily flexible and the abrasive finishing media are at least an order of magnitude smaller in volume and weight than the workpieces, and, wherein the step of periodically opening the closure is effected by biasing the closure in a closing direction with such force as will permit the closure to be opened from time to time to discharge workpieces bearing against the closure.

18. A method of finishing workpieces in the presence of finishing media, comprising the steps of:

(a) introducing workpieces and finishing media into the tub of a vibratory finishing machine, the machine being of the type having a discharge structure including a closure for selectively opening and closing a tub outlet, the workpieces being introduced into the tub at a location removed from the tub outlet;

(b) vibrating the tub to impart a finishing action to the workpieces in the tub and to move the workpieces from said location toward the tub outlet; and, (c) periodically opening and closing the closure to discharge workpieces and media from the tub, the opening of the closure being in response to an increase in pressure forces exerted on the closure by workpieces and media bearing against the closure, and closing of the closure being in response to a decrease in such pressure forces.

* * * * *